US006176595B1

(12) United States Patent
Bomas

(10) Patent No.: US 6,176,595 B1
(45) Date of Patent: Jan. 23, 2001

(54) VERTICAL CANOPY ADJUSTABLE PATH LIGHT

(76) Inventor: Bert C. Bomas, 2895 Hwy. 49 West, Ashland, City, TN (US) 37015

( * ) Notice: Under 35 U.S.C. 154(b), the term of this patent shall be extended for 0 days.

(21) Appl. No.: 09/217,511

(22) Filed: Dec. 21, 1998

(51) Int. Cl.[7] ..... F21V 1/00

(52) U.S. Cl. ..... 362/241; 362/152; 362/250; 362/523

(58) Field of Search ..... 362/241–250, 362/523, 152, 153, 282, 322, 296

(56) References Cited

U.S. PATENT DOCUMENTS 3,589,799 * 6/1971 Hotchkiss ..... 350/237
4,404,620 * 9/1983 Takahashi et al. ..... 362/304
4,656,569 * 4/1987 Buskell ..... 362/418

* cited by examiner

*Primary Examiner*—Sandra O'Shea
*Assistant Examiner*—Bertrand Zeade

(74) *Attorney, Agent, or Firm*—Michael I Kroll

(57) ABSTRACT

A lighting fixture connected to a power source for illuminating an area. The lighting fixture includes a housing having a first end, a second end and a socket for receiving a light bulb positioned in the first end. A canopy including a hemispherical member having a first reflective side and a vertical member having a cavity cut through a portion thereof extending through a central portion of the hemispherical member is adjustably connected to the first end of the housing by a securing device. The light bulb within the socket is at least partially positioned within the cavity such that light produced by the light bulb at least partially passes through the cavity and is reflected by said reflective side of the hemispherical member to illuminate the desired area when the canopy is secured atop the first side of the housing. The securing device includes at least two vertically aligned recesses extending through the first end of the housing, a recess extending through the vertical member and a pin releasably positioned to extend through a selected one of said at least two vertically aligned recesses and the recess extending through the vertical member. The housing further includes a second slanted end for insertion into the area desired to be illuminated and a cover is provided for covering the cavity and thereby protect the lightbulb.

6 Claims, 5 Drawing Sheets

VERTICAL CANOPY ADJUSTABLE PATH LIGHT

BACKGROUND OF THE INVENTION

1. Field of the Invention

The present invention relates generally to garden lighting fixtures and, more specifically, to an illumination device for providing aesthetically pleasing low wattage lighting to a desired area including a substantially hemispherical canopy, the height of the canopy being adjustable for controlling the amount of light projected by the device.

2. Description of the Prior Art

Numerous types of garden lighting fixtures designed to provide patios, decks, and pathways with illumination have been provided in the prior art. For example, U.S. Pat. Nos. 4,656,569; 5,406,466; 5,414,607; 5,463,535 and 5,692,828 all are illustrative of such prior art. While these units may be suitable for the particular purpose to which they address, they would not be as suitable for the purposes of the present invention as heretofore described.

U.S. Pat. No. 4,656,569

Inventor: Hugh Buskell

Issued: Apr. 7, 1987

An assembly for elevating particularly a lamp canopy on a lamp standard comprises a screw arranged longitudinally of the standard and rotatable at a lower end to drive the canopy up and down the mast. The screw is located in a channel formed by flanges exterially of the mast. Nuts separate from the canopy can be moved up and down the screw to support cables to the lamp and to stabilize the screw. The channel can be covered by cover plates applied to the channel and carried along the channel by the raising canopy.

U.S. Pat. No. 5,406,466

Inventor: Dana A. Stokes

Issued: Apr. 11, 1995

A garden light in which the base is a segment of natural bamboo, the globe surrounding the incandescent lamp is a transparent food jar, and the shade includes an inverted rice bowl and an inverted wooden salad plate both of which are cemented to the bottom flange of the food jar. The lamp is mounted in a garden by burying or driving its butt into the ground.

U.S. Pat. No. 5,414,607

Inventor: William F. Harris et al.

Issued: May 9, 1995

An outdoor ground supported light fixture having a non-conductive hollow staff and having a lower end for disposition in the ground and an upper end where electrical conductor elements are received by the lower end into the staff and where the electrical conductor elements exit the staff from the upper end is disclosed. The light fixture also includes a shade unit having a non-conductive wiring compartment integral therewith. The unit has a top end and a bottom end with the wiring compartment located at the bottom end of the unit. The bottom end of the unit is for connection with the upper end of the staff. The compartment has a base with an aperture therein for receiving the electrical conductor elements from the upper end of the staff through the aperture. The compartment has a lamp receiving device devised for connecting a lamp to the electrical conductor elements.

U.S. Pat. No. 5,463,535

Inventor: William C. Vest

Issued: Oct. 31, 1995

A light for illuminating structure around a post. The inventive device includes a main body having a cylindrical lens extending therearound. A lower post coupler is mounted to a first end of the main body and can be coupled to a weighted base of a table umbrella. An upper post coupler is mounted to a second end of the main body and can receive a post of a table umbrella. A light bulb is mounted within the main body to effect lighting of structure around the umbrella post, such as a table or the like.

U.S. Pat. No. 5,692,828

Inventor: Lee Hsin-chih Chung

Issued: Dec. 2, 1997

A garden lamp includes a lamp body made of a light transmission material with a bulb fixed therein and having a bore with an opening in which rigid, conductive spikes in connection with the bulb are fixed and a post having a sharpened lower end to pierce into the ground and a top end for receiving thereon the bore of the lamp body. The post includes a hollow central section connecting between the lower end and the top end rotatable relative to the central section about a common axis. An upward convex arcuate groove is provided on the top end of the post to receive and hold therein wires. Two pegs respectively extend radially from the top end and the central section of the post. The bore of the lamp body has a straight slot and an inclined slot provided on an inside surface thereof with the inclined slot extending upward from the straight slot so as to allow the lamp body to fit onto and secured on the top end of the post by having the pegs received within the straight slot to such a location where the peg on the central section is allowed to move into the inclined slot by relative rotation between the top end and the central section of the post. The central section has two lower openings and two upper openings to allow wires to extend therethrough.

SUMMARY OF THE PRESENT INVENTION

The present invention relates generally to garden lighting fixtures and, more specifically, to an illumination device for providing aesthetically pleasing low wattage lighting to a desired area including a substantially hemispherical canopy having a cavity covered by a cylindrically shaped transparent member to provide egress for the light beam, the height of the canopy being adjustable for controlling the amount of light projected by the device.

A primary object of the present invention is to provide a garden lighting fixture that will overcome the shortcomings of prior art devices.

Another object of the present invention is to provide a garden lighting fixture which is able to provide adequate lighting to a desired area such as a path or sidewalk or to accent the landscape of a property.

A further object of the present invention is to provide a garden lighting fixture including a vertically adjustable canopy for varying an amount of light provided by the device.

A yet further object of the present invention is to provide a garden lighting fixture wherein the canopy includes an aperture through which light is directed.

A still further object of the present invention is to provide a garden lighting fixture wherein the canopy acts to direct the light produced by the device in a downward direction.

An even further object of the present invention is to provide a garden lighting fixture wherein the aperture has a cover extending thereover, the cover being of any desired color to thereby tint the light produced by the device.

Another object of the present invention is to provide a garden lighting fixture that is simple and easy to use.

A yet further object of the present invention is to provide a garden lighting fixture that is economical in cost to manufacture.

Additional objects of the present invention will appear as the description proceeds.

A lighting fixture connected to a power source for illuminating an area is disclosed by the present invention. The lighting fixture includes a housing having a first end, a second end and a socket for receiving a light bulb positioned in the first end. A canopy including a hemispherical member having a first reflective side and a vertical member having a cavity cut through a portion thereof extending through a central portion of the hemispherical member is adjustably connected to the first end of the housing by a securing device. The light bulb within the socket is at least partially positioned within the cavity such that light produced by the light bulb at least partially passes through the cavity and is reflected by said reflective side of the hemispherical member to illuminate the desired area when the canopy is secured atop the first side of the housing. The securing device includes at least two vertically aligned recesses extending through the first end of the housing, a recess extending through the vertical member and a pin releasably positioned to extend through a selected one of said at least two vertically aligned recesses and the recess extending through the vertical member. The housing further includes a second slanted end for insertion into the area desired to be illuminated and a cover is provided for covering the cavity and thereby protect the lightbulb.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
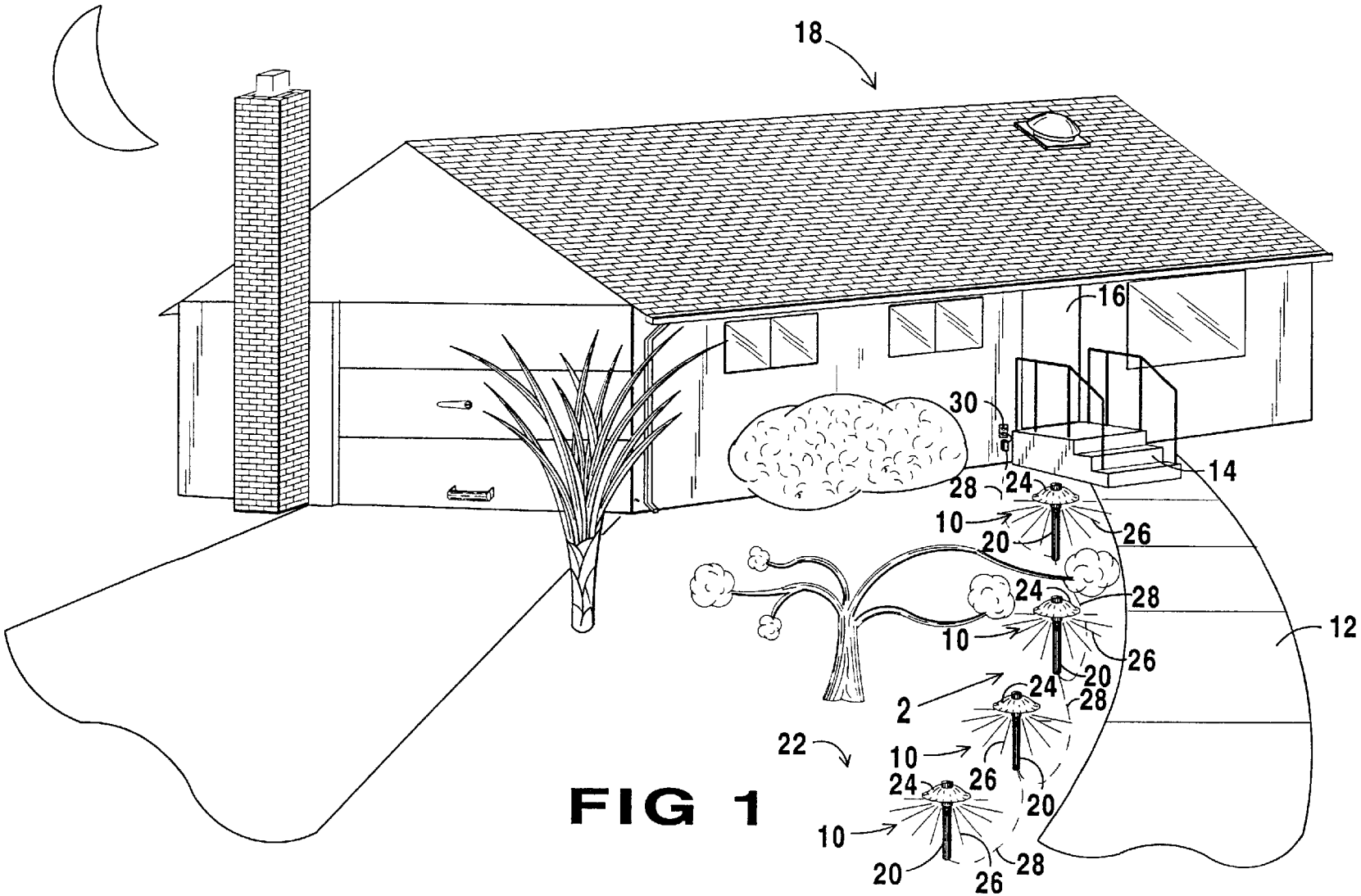
FIG. 1 is a perspective view of an outdoor area being illuminated by the garden lighting fixture of the present invention.

Turning now descriptively to the drawings, in which similar reference characters denote similar elements throughout the several views, the Figures illustrate the vertical canopy adjustable path light of the present invention. With regard to the reference numerals used, the following numbering is used throughout the various drawing figures.

10 vertical canopy adjustable path light of the present invention
12 path lit by well lights
14 stoop at end of path
16 front door of house
18 house
20 housing of vertical canopy adjustable path light
22 ground
24 canopy of vertical canopy adjustable path light
26 lines representing projecting light
28 electrical power cord
30 electrical outlet
32 bottom side of housing
34 top side of housing
36 vertically aligned recesses in top side of housing
38 light bulb
40 vertical member of canopy
42 hemispherical member of canopy
44 recess in vertical member of canopy
46 pin for releasably securing canopy to housing
48 cavity in vertical member of canopy
50 transparent cover for cavity
52 recess in housing for electrical power cord
54 rubber seal around recess for electrical power cord
56 adapter on end of electrical power cord
58 first prong of adapter
60 second prong of adapter
62 electrically conductive end of first prong
64 electrically conductive end of second prong
66 lines representing light reflected at a first angle
68 lines representing light reflected at a second angle
70 lines representing light reflected at a third angle

DETAILED DESCRIPTION OF THE PREFERRED EMBODIMENT

Turning now descriptively to the drawings, in which similar reference characters denote similar elements throughout the several views, FIGS. 1 through 5C illustrate the vertical canopy adjustable path light of the present invention indicated generally by the numeral 10.

The vertical canopy adjustable path light 10 is illustrated in FIG. 1. In this figure a number of vertical canopy adjustable path lights 10 are positioned along a path 12 leading to a stoop 14 and front door 16 of a house 18. Each of the vertical canopy adjustable path lights 10 are able to illuminate a portion of the path 12. Each vertical canopy adjustable path light 10 includes a housing 20 which is inserted in the ground 22 and extends substantially vertically therefrom. A vertically adjustable canopy 24 is releasably connected to an end of the housing 20 opposite the ground 22. The vertical position of the canopy 24 determines the amount of illumination provided by the vertical canopy adjustable path light 10 and the direction at which the light is projected. The projection of the light is indicated by the lines 26 emanating from each of the vertical canopy adjustable path lights 10. Extending from the housing 20 of each of the vertical canopy adjustable path lights 10 is a power cord 28 for connection to an electrical power supply 30. The power cord 28 may include an adapter for connection with an electrical raceway extending along the length of the path 12 being illuminated and connected at one end to an electrical power source. The adapter will be discussed in greater detail with reference to FIGS. 2 and 3.

Use of the vertical canopy adjustable path light 10 of the present invention is not limited to illumination of a path 12 leading to a front door 16 of a house 18 but may be used to illuminate any walkway or driveway such as a sidewalk, path through a yard or even paths within a park.

Figure 2:
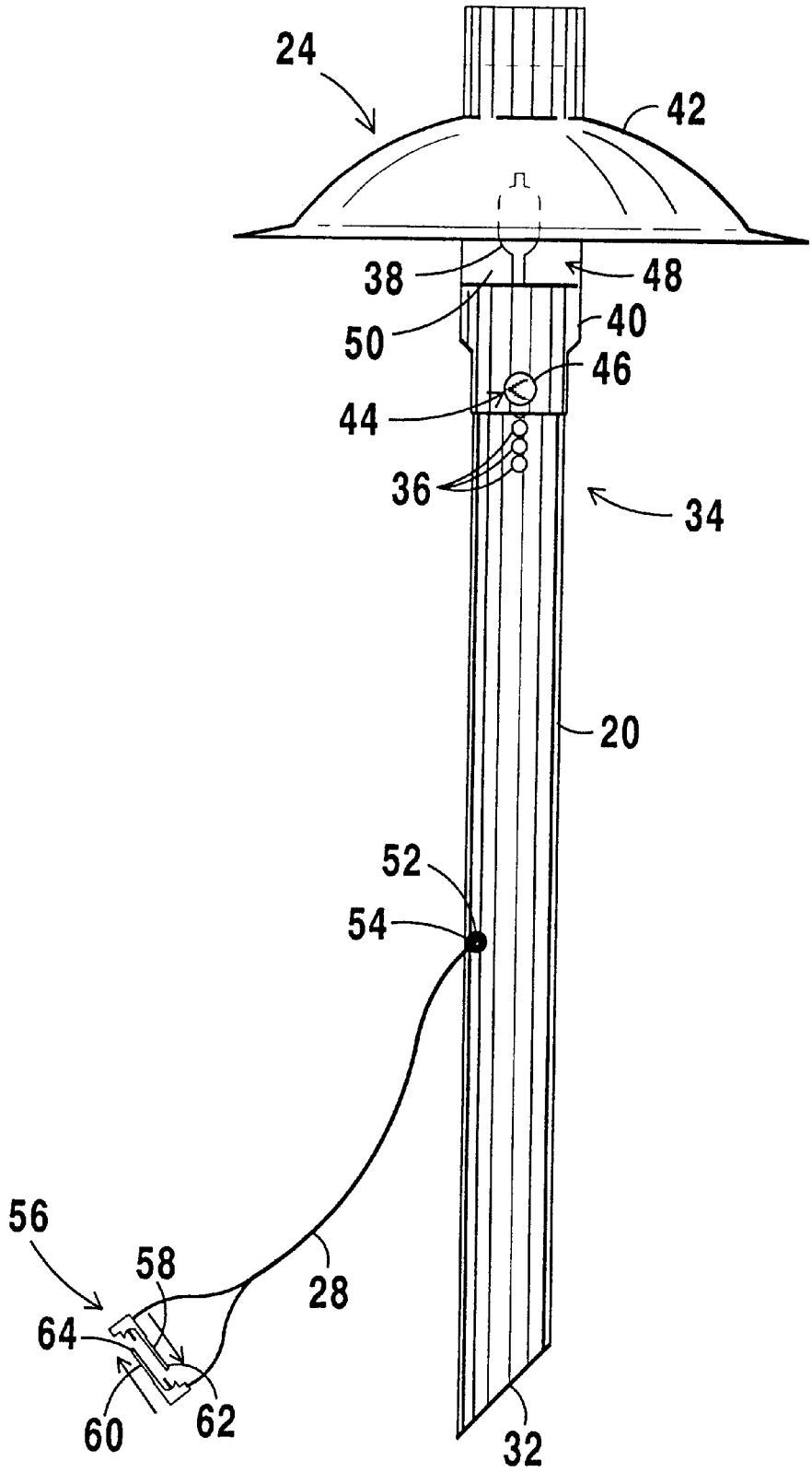
FIG. 2 is a side view of the garden lighting fixture of the present invention.

A side view of the vertical canopy adjustable path light 10 is illustrated in FIG. 2. As can be seen from this figure, the vertical canopy adjustable path light 10 includes a substantially cylindrical housing 20 having a slanted bottom side 32 for aiding the user in inserting the vertical canopy adjustable path light 10 into the ground 16. At a top side 34 of the housing 20 are a plurality of vertically aligned recesses 36 and a light bulb 38 is positioned to extend from a light socket positioned in the top side 34. The canopy 24 includes a vertical member 40 extending through a central portion of a hemispherical member 42. The vertical member 40 is hollow and includes a recess 44 extending therethrough. The top side of the housing 20 is received within the vertical member 40 when the vertical canopy adjustable path light 10 is assembled for use. Alternatively, the top side of the housing 20 may receive the vertical member 40 therein when the vertical canopy adjustable path light 10 is assembled for use. The vertical member 40 is releasably connected to the housing 20 by insertion of a pin 46 through the recess 44 and a selected one of the vertically aligned recesses 36 extending through the top side 34 of the housing 20. A cavity 48 is cut through a portion of the vertical member 40 providing egress for the light produced by the light bulb 38 when the canopy 24 is positioned atop the housing 20. The cavity 48 may be covered by a transparent member 50 for protecting the light bulb 38.

Extending through a recess 52 in the housing 20 is the electrical power cord 28. The recess 52 is preferably covered by an elastomeric ring 54 for sealing the recess 52 and preventing anything from entering the housing 20 through the recess 52 which may harm the operation of the adjustable path light 10. At an end of the electrical power cord 28 is an adapter 56. The adapter 56 includes first and second prongs 58 and 60 for piercing and connection to an electrical raceway (not shown). Each of the first and second prongs 58 and 60 include an electrically conductive end 62 and 64, respectively, for contacting the electrical wires within the raceway to which they will be connected. The opposite end of the electrical power cord 28 is connected to a socket for receiving the light bulb 38.

The amount of light allowed to exit through the cavity 48 and the angle at which the light is directed is determined by the height at which the canopy 24 is releasably secured to the housing 20. The height of the canopy 24 is dependent upon which of the vertically aligned recesses 36 is selected for receiving the pin 46. Selection of the lowest of the recesses 36 allows the least amount of light to pass through the cavity 48 in the vertical member 40 whereby the hem i spherical member 42 directs the light impingent thereon to cover a narrow area. Selection of the highest of the recesses 36 the greatest amount of light to pass through the cavity 48 whereby the hemispherical member 42 directs the light impingent thereon to cover a wide area.

Figure 3:
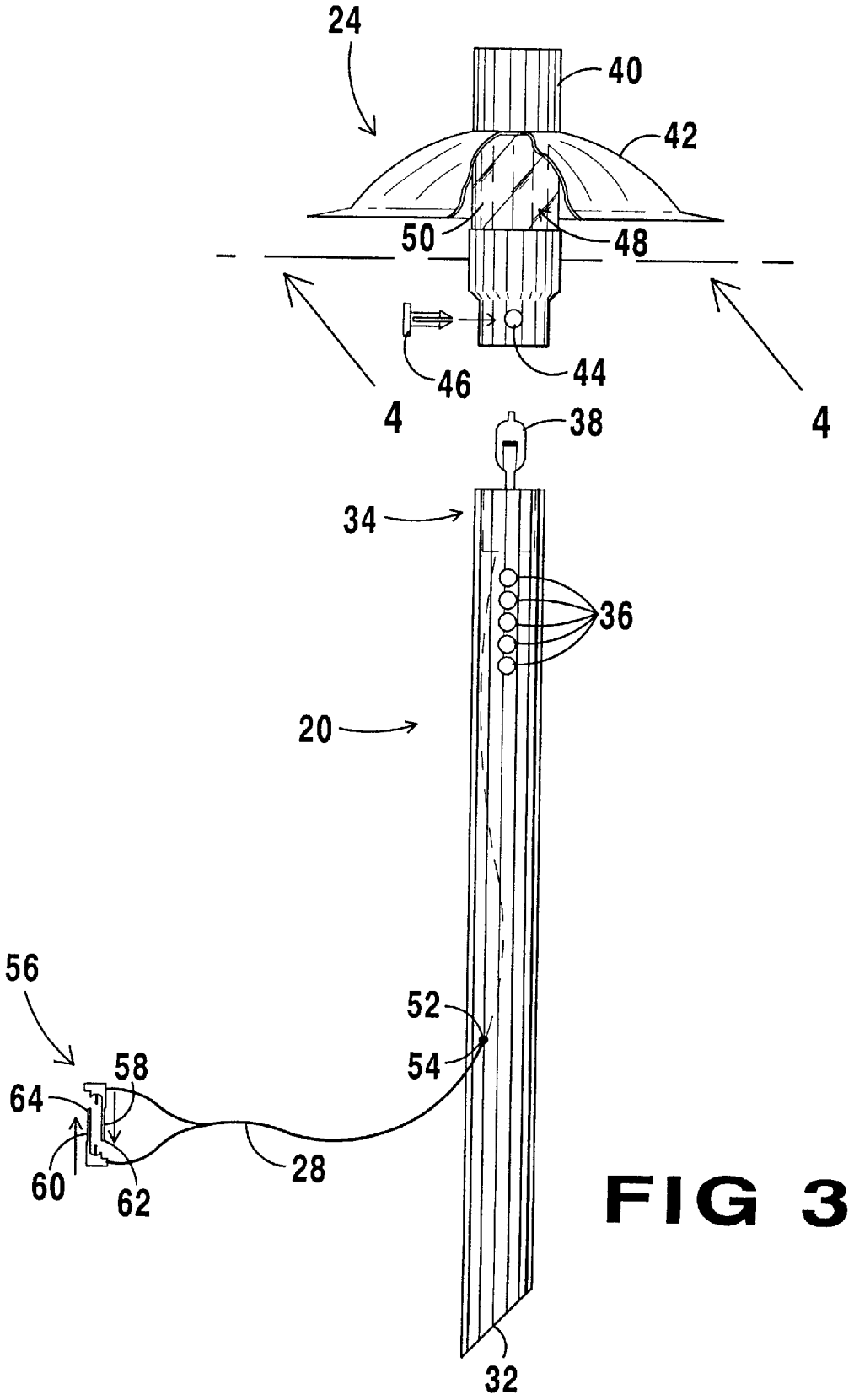
FIG. 3 is a side exploded view with parts cut away of the garden lighting

An exploded view of the vertical canopy adjustable path light 10 is illustrated in FIG. 3. As can be seen from this figure, the cylindrical housing 20 is hollow and includes a slanted bottom side 32 and a flat top side 34. A plurality of vertically aligned recesses 36 extend through the top side 34 of the housing 20. Extending from the top side 34 of the housing 20 is the light bulb 38.

The canopy 24 includes the vertical member 40 and the hemispherical member 42. The vertical member 40 extends through a central portion of and positioned within the arc formed by the hemispherical member 42 and includes a recess 44 on a lower end thereof. The lower end of the vertical member 40 is releasably positioned within the top side 34 of the housing 20 so that the recess 44 is aligned with one of the plurality of vertically aligned recesses 36. The pin 46 is releasably inserted through the one of the vertically aligned recesses 36 and the recess 44 for releasably securing the canopy 24 atop the housing 20 at a desired height. The vertical member 40 includes the cavity 48 cut therein with the cover 50 positioned thereover for allowing egress of light produced by the light bulb 38 therethrough. The hemispherical member 42 reflects the light passing through the cavity 48 and cover 50 at an angle thereto and towards the ground. The amount of light and the angle at which the light is directed is dependent upon the height at which the canopy 24 is positioned on the housing 20. The height of the canopy 24 is dependent upon which of the vertically aligned recesses is aligned with the recess 44 in the vertical member 40.

Extending from the housing 20 is the electrical power cord 28. The electrical power cord 28 includes the adapter 56 for connection to an electrical raceway which may extend along the path to be illuminated for supplying electricity to the vertical canopy adjustable path lights 10. The adapter 56 includes the first and second prongs 58 and 60 each including an electrically conductive end 62 and 64 able to pierce the cover of the electrical raceway and provide power to the light bulb 38 of the vertical canopy adjustable path light 10.

Figure 4:
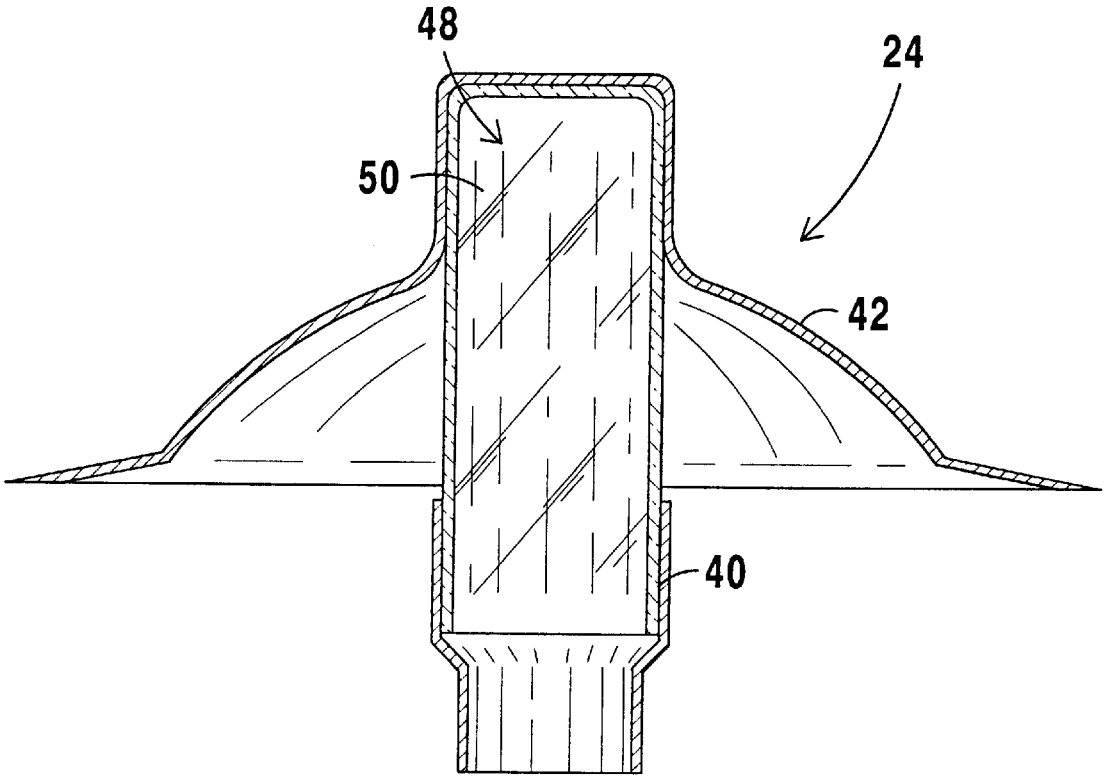
FIG. 4 is a side cross-sectional view of the canopy of the garden lighting fixture of the present invention taken along the line 4—4 of FIG. 3.

An enlarged cross-sectional view of the canopy 24 is illustrated in FIG. 4. This view is taken along the line 4—4 of FIG. 3. As can be seen from this figure, the canopy 24 includes the vertical member 40 and the hemispherical member 42. The vertical member 40 is positioned in a central portion of the hemispherical member 42 such that the hemispherical member 42 forms a reflective pool surrounding the vertical member 40. The cavity 48 is cut into the vertical member 40 and extends substantially halfway around the circumference of the vertical member 40. The cover 50 is positioned over the cavity 48 so as to close the vertical member 40 to the ambient atmosphere. The hemispherical member 42 may include a protrusion extending from the central portion thereof for receiving the vertical member 40 therein as illustrated in this figure. Alternatively, the hemispherical member 42 may include a recess extending through the central portion thereof through which a portion of the vertical member 40 extends.

Figure 5C:
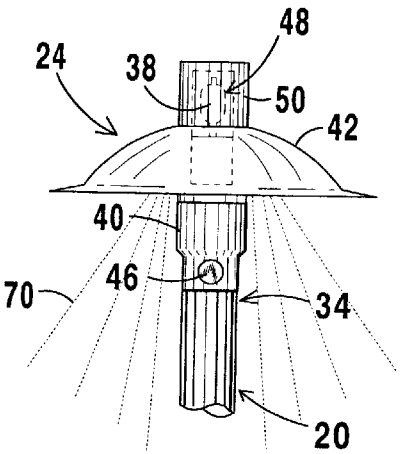
FIG. 5C is a side view of the garden lighting fixture of the present invention having the canopy set at a third height.
Figure 5B:
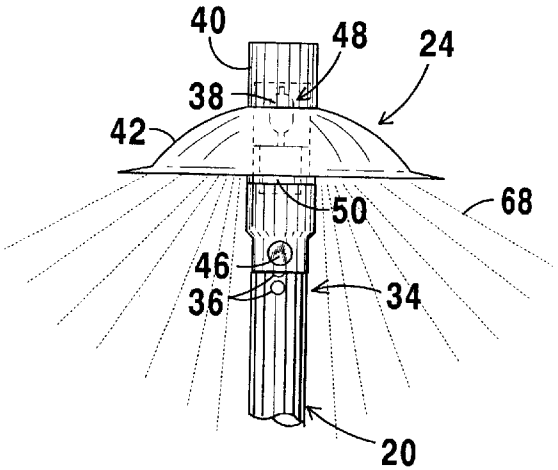
FIG. 5B is a side view of the garden lighting fixture of the present invention having the canopy set at a second height.
Figure 5A:
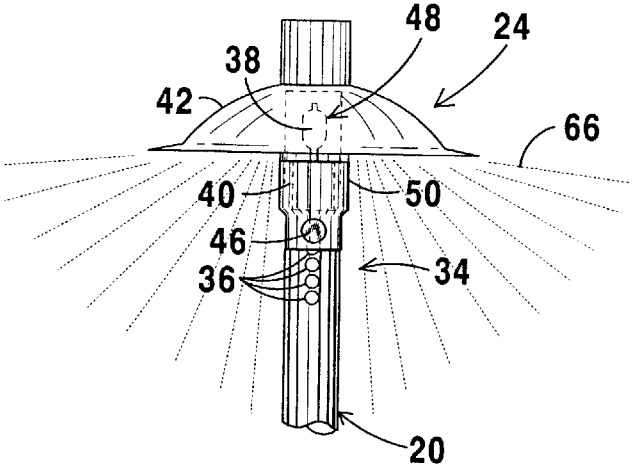
FIG. 5A is a side view of the garden lighting fixture of the present invention having the canopy set at a first height.

FIGS. 5A, 5B and 5C illustrate the vertical canopy adjustable path light 10 projecting light produced thereby at different angles. In FIG. 5A the canopy 24 is secured to the housing 20 whereby the top one of the vertically aligned recesses 36 is aligned with the recess 44 extending through the vertical member 40. In this position the entire light bulb is received within the cavity 48. The inner surface of the hemispherical member 42 is formed of a reflective surface and due to the arced shape of the hemispherical member 42 the light passing through the cover 50 is reflected downward. The angle of reflection is dependent upon the angle at which the light is impingent on the reflective surface and the point on the arc at which the light is impingent. The reflection of light produced by the positioning of the canopy 24 as illustrated in FIG. 5A is indicated by the dashed lines labeled with the numeral 66. The canopy 24 positioned as shown in FIG. 5A provides light for the greatest area possible with the vertical canopy adjustable path light 10. FIG. 5B illustrates the canopy positioned such that the recess 44 in the vertical member 40 is aligned with a centrally located one of the vertically aligned recesses 36. In this position, a portion of the light bulb 38 extends above the cavity 48 and thus all the light produced does not pass out of the cavity 48. The light reflected by the canopy 24 when in this position is more concentrated and covers a smaller area than the light reflected by the canopy 24 as positioned in FIG. 5A. FIG. 5C illustrates the canopy 24 positioned such that the recess 44 in the vertical member 40 is aligned with the bottom one of the vertically aligned recesses 36. In this position a minimum area of the light bulb 38 is within the cavity 48 and thus most of the light produced by the light bulb 38 will not pass through the cavity 48. Positioning the canopy 24 in this manner provides the most concentrated reflection of light produced covering the smallest area.

The vertical canopy adjustable path light 10 may be adapted to provide illumination of an area or path with different colored or tinted lights to thereby change the tint of the produced light to a desired color. This effect can be created by using a colored light bulb 38 with a clear transparent cover 50 over the cavity 48 or using a colored cover 50 positioned over the cavity 48. Use of such a light bulb or cover would produce a tinted light which may be desirable for decorative purposes.

The operation of the vertical canopy adjustable path light 10 will now be described with reference to the figures. In operation, the vertical canopy adjustable path light 10 is first assembled by placing the desired color light within the socket positioned at the top end 34 of the housing 20. The desired color cover 50 is then selected and is secured to cover the cavity 48. The desired height of the canopy 24 for producing the desired concentration of light covering the desired amount of area is now selected. Once selected, the one of the vertically aligned recesses 36 which would need to be aligned with the recess 44 in the vertical member 40 is selected and that recess 36 is aligned with the recess 44. The securing pin 46 is then inserted through the aligned recesses. The vertical canopy adjustable path light 10 is now ready for use.

The user will now select a desired location for the vertical canopy adjustable path light 10 and a desired area or path to be illuminated thereby. The vertical canopy adjustable path light 10 will be positioned in the desired location and the power cord 24 will be connected to a supply of electricity. The vertical canopy adjustable path light 10 will now be turned on to produce an illumination. The desired area is now illuminated. The user may position additional vertical canopy adjustable path lights 10 along the path or within the area desired to be lit to thereby provide further illumination. The additional vertical canopy adjustable path lights 10 will be assemble as described above and positioned as desired along the path or within the area.

From the above description it can be seen that the garden lighting fixture of the present invention is able to overcome the shortcomings of prior art devices by providing a garden lighting fixture which is able to provide adequate lighting to a desired area such as paths and sidewalks or to accent the landscape of a property. The garden lighting fixture includes a vertically adjustable canopy for varying an amount of light provided by the device and directing the light produced by the device in a downward direction through an aperture therein. The aperture includes a cover extending thereover, the cover being of any desired color to thereby tint the light produced by the device. Furthermore, the outdoor durable well light of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A lighting fixture connected to a power source for illuminating an area, said lighting fixture comprising:

a) a cylindrical, vertically extending stationary housing including a first top end, a second bottom end and a socket for receiving a light bulb positioned in said first end;

b) a vertically adjustable canopy including a hemispherical member having a first reflective side and a vertical cylindrical member, said hemispherical member having a cavity cut through a portion thereof extending through a central portion of said hemispherical member through which said vertical cylindrical member extends, said vertical cylindrical member having a bottom opening adapted to slide over said top end of said stationary housing; and c) means for adjustably securing said hemispherical and vertical members on said first top end of said housing comprising a plurality of vertically aligned recesses extending through said first top end of said housing, a recess extending through said vertical member and a pin releasably positioned to extend through a selected one of said plurality of vertically aligned recesses and said recess extending through said vertical member for selecting a vertical distance between said light bulb and the reflective side of said hemispherical member whereby moving said canopy results in changing the angle of light rays spreading out from said canopy.

2. The lighting fixture as recited in claim 1, wherein said housing further includes a second slanted end for insertion into the area desired to be illuminated.

3. The lighting fixture as recited in claim 1, wherein the power source is an electrical raceway and said lighting fixture further comprises an electrical cord extending from said housing, said electrical cord including a first end connected to provide power to said socket and a second end including an adapter for connection to the electrical raceway.

4. The lighting fixture as recited in claim 3, wherein said adapter includes a first prong and a second prong for piercing a cover of the electrical raceway to receive power therefrom.

5. The lighting fixture as recited in claim 1, further comprising a cover for covering said cavity to thereby protect the lightbulb.

6. The lighting fixture as recited in claim 5, wherein said cover is of a desired color to provide a tint to light passing through said cavity.

* * * * *